US007988341B2

(12) United States Patent
Chen

(10) Patent No.: US 7,988,341 B2
(45) Date of Patent: Aug. 2, 2011

(54) OUTDOOR HIGH POWDER LIGHT-EMITTING DIODE ILLUMINATING EQUIPMENT

(75) Inventor: Jen-Shyan Chen, Hsinchu (TW)

(73) Assignee: Neobulb Technologies, Inc. (BN)

( * ) Notice: Subject to any disclaimer, the term of this patent is extended or adjusted under 35 U.S.C. 154(b) by 0 days.

(21) Appl. No.: 12/758,352

(22) Filed: Apr. 12, 2010

(65) Prior Publication Data

US 2010/0194273 A1 Aug. 5, 2010

Related U.S. Application Data

(63) Continuation of application No. 11/984,727, filed on Nov. 21, 2007, now Pat. No. 7,736,032.

(51) Int. Cl.
*F21V 29/00* (2006.01)

(52) U.S. Cl. ..... 362/373; 362/294; 362/101

(58) Field of Classification Search ..... 362/294, 362/373, 544
See application file for complete search history.

(56) References Cited

U.S. PATENT DOCUMENTS 5,857,767 A * 1/1999 Hochstein ..... 362/294
6,995,405 B2 * 2/2006 Braddell et al. ..... 257/99
7,281,832 B2 * 10/2007 Ishida et al. ..... 362/544
7,338,186 B1 * 3/2008 Wu et al. ..... 362/294
7,344,296 B2 * 3/2008 Matsui et al. ..... 362/652
7,736,032 B2 * 6/2010 Chen ..... 362/373
2009/0016272 A1 1/2009 Li

OTHER PUBLICATIONS

Non-Final Office Action in parent U.S. Appl. No. 11/984,727 mailed Mar. 19, 2009.

* cited by examiner

*Primary Examiner* — Anabel M Ton
(74) *Attorney, Agent, or Firm* — Thomas, Kayden, Horstemeyer & Risley, LLP.

(57) ABSTRACT

The invention provides a light-emitting diode illuminating equipment. The light-emitting diode illuminating equipment of the invention includes a heat-dissipating plate device, a plurality of heat-dissipating fins, a diode light-emitting apparatus, a plurality of heat-conducting devices, and a shield device. The heat-dissipating fins extend from a surface of the heat-dissipating plate device. By tightly mounting the heat-conducting devices on the surface of the heat-dissipating plate device and disposing between the heat-dissipating fins, heat generated during the operation of the diode light-emitting apparatus is distributed uniformly on the heat-dissipating plate device and the heat-dissipating fins due to the high efficiency heat-conducting of the heat-conducting devices, and then is dissipated. Besides, the shield device has a waterproof passage for a power cord passing through to power a control circuit, such that the light-emitting diode illuminating equipment is adapted to be installed outdoors.

8 Claims, 5 Drawing Sheets

OUTDOOR HIGH POWDER LIGHT-EMITTING DIODE ILLUMINATING EQUIPMENT

This application is a continuation of co-pending U.S. utility application entitled "Outdoor High Power Light-Emitting Diode Illumination Equipment," having Ser. No. 11/984,727, filed Nov. 21, 2007 which is incorporated by reference herein in its entirety.

BACKGROUND OF THE INVENTION

1. Field of the Invention

This present invention relates to a light-emitting diode illuminating equipment, and more particularly, to a light-emitting diode illuminating equipment adapted to be installed outdoors.

2. Description of the Prior Art

A light-emitting diode (LED) has advantages of power saving, vibration resistance, fast response, production ability, and so on, so the illuminating equipment with light sources of LEDs is currently being studied and developed. When the current high-power LED emits continually in a period of time, there is a problem of over-high temperature so that the luminous efficiency of the LED is decreased and the luminance cannot be increased. Therefore, any product with high-power LEDs requires a good heat-conducting and heat-dissipating mechanism. In addition, most of the current fixed illuminating equipment is big and is inconvenient to move, and however, the luminance of conventional illuminating equipment with little volume and portability is insufficient. Therefore, portability and luminance cannot be satisfied concurrently.

Therefore, there is a need to provide a light-emitting diode illuminating equipment with little volume, high power, portability, and applicability of outdoor installation.

SUMMARY OF THE INVENTION

A scope of the invention is to provide an outdoor light-emitting diode illuminating equipment.

According to a preferred embodiment, a light-emitting diode illuminating equipment of the invention includes a heat-dissipating plate device, a plurality of heat-dissipating fins, a first heat-conducting device, a diode light-emitting apparatus, a plurality of second heat-conducting devices, and a shield device. The heat-dissipating plate device has a first surface and a second surface opposite to the first surface. The heat-dissipating fins extend from the second surface of the heat-dissipating plate device. The first heat-conducting device has a first portion and a second portion extending from the first portion and having a flat end. The first portion is tightly mounted on the first surface of the heat-dissipating plate device. The diode light-emitting apparatus is disposed on the flat end of the second portion of the first heat-conducting device and converts electric energy into light. The second heat-conducting devices are disposed on the first surface of the heat-dissipating plate device, or on the second surface of the heat-dissipating plate device and arranged between the heat-dissipating fins, such that heat produced in operation by the diode light-emitting apparatus is distributed uniformly on the heat-dissipating plate device and then is dissipated by the heat-dissipating plate device and the heat-dissipating fins. The shield device is engaged with a circumference of the heat-dissipating plate device via a heat-isolating ring to form a sealed space to accommodate the diode light-emitting apparatus and the first heat-conducting device. The shield device has a transparent shield enabling the light emitted by the diode light-emitting apparatus to pass through to provide illumination.

In addition, the light-emitting diode equipment further includes a control circuit in the sealed space. The control circuit is electrically connected to the diode light-emitting apparatus for controlling the diode light-emitting apparatus to emit the light. The shield device has a waterproof passage for a power cord passing through to power the control circuit. Therefore, the high power light-emitting diode illuminating equipment of the invention has high heat-dissipating efficiency and has a sealed structure adapted for outdoor illumination as well.

The advantage and spirit of the invention may be understood by the following recitations together with the appended drawings.

BRIEF DESCRIPTION OF THE APPENDED DRAWINGS

DETAILED DESCRIPTION OF THE INVENTION

Figure 1A:
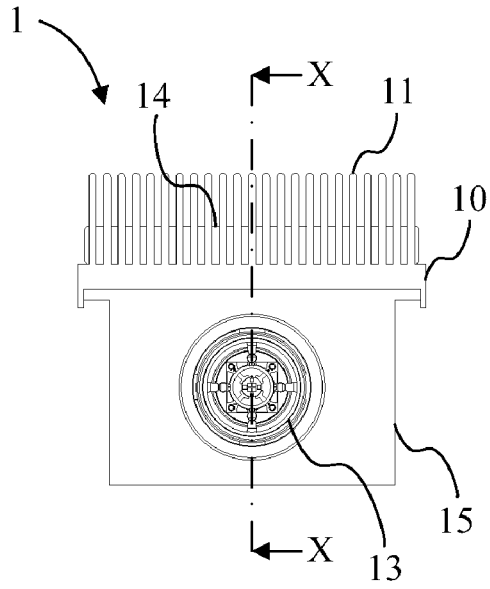
FIG. 1A is a sketch diagram illustrating a light-emitting diode illuminating equipment according to a first preferred embodiment of the invention.
Figure 1B:
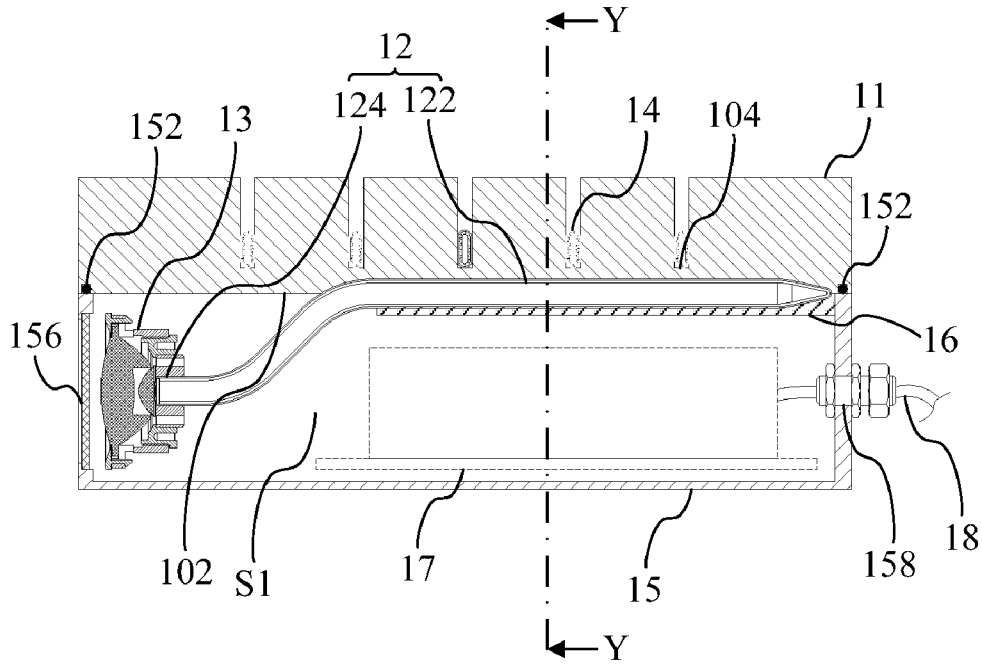
FIG. 1B is a cross section of the light-emitting diode illuminating equipment along X-X line in FIG. 1A.
Figure 1C:
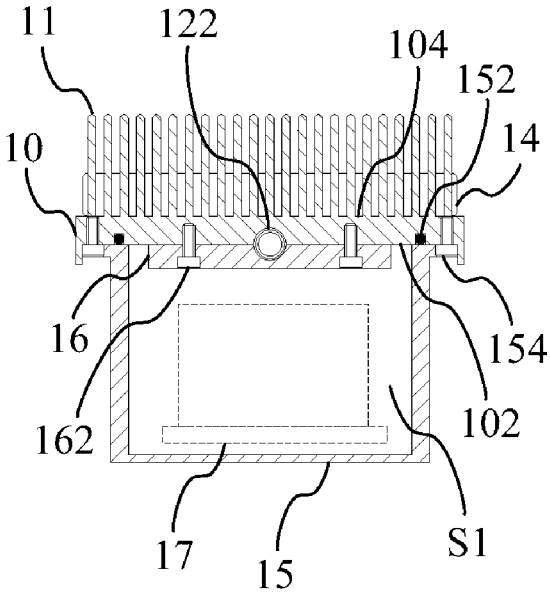
FIG. 1C is a cross section of the light-emitting diode illuminating equipment along Y-Y line in FIG. 1B.

Please refer to FIG. 1A through 1C. FIG. 1A is a sketch diagram illustrating a light-emitting diode illuminating equipment 1 according to a first preferred embodiment of the invention. FIG. 1B is a cross section of the light-emitting diode illuminating equipment 1 along X-X line in FIG. 1A. FIG. 1C is a cross section of the light-emitting diode illuminating equipment 1 along Y-Y line in FIG. 1B.

According to the first preferred embodiment, the light-emitting diode illuminating equipment 1 of the invention includes a heat-dissipating plate device 10, a plurality of heat-dissipating fins 11, a first heat-conducting device 12, a diode light-emitting apparatus 13, a plurality of second heat-conducting devices 14, a shield device 15, a depressor 16, and a control circuit 17 (including a circuit board and other electronic components requested).

The heat-dissipating plate device 10 has a first surface 102 and a second surface 104 opposite to the first surface 102. The heat-dissipating fins 11 extend from the second surface 104 of the heat-dissipating plate device 10. The first heat-conducting device 12 has a first portion 122 and a second portion 124 extending from the first portion 122 and having a flat end. The first portion 122 is mounted on the first surface 102 of the heat-dissipating plate device 10 by a depressor 16. The depressor 16 is screwed with several screws 162 so that the depressor 16 presses the first portion 122 to be tightly mounted on the first surface 102. The first heat-conducting device 12 can be a heat pipe, a vapor chamber, or other device with high heat-conducting efficiency.

The diode light-emitting apparatus 13 is disposed on the flat end of the second portion 124 of the first heat-conducting device 12 and converts electric energy into light. The direction of the light emitted by the diode light-emitting apparatus 13 is substantially parallel to the heat-dissipating plate device 10. The diode light-emitting apparatus 13 has at least one high power light-emitting diode chip or at least one high power laser diode chip.

Figure 2A:
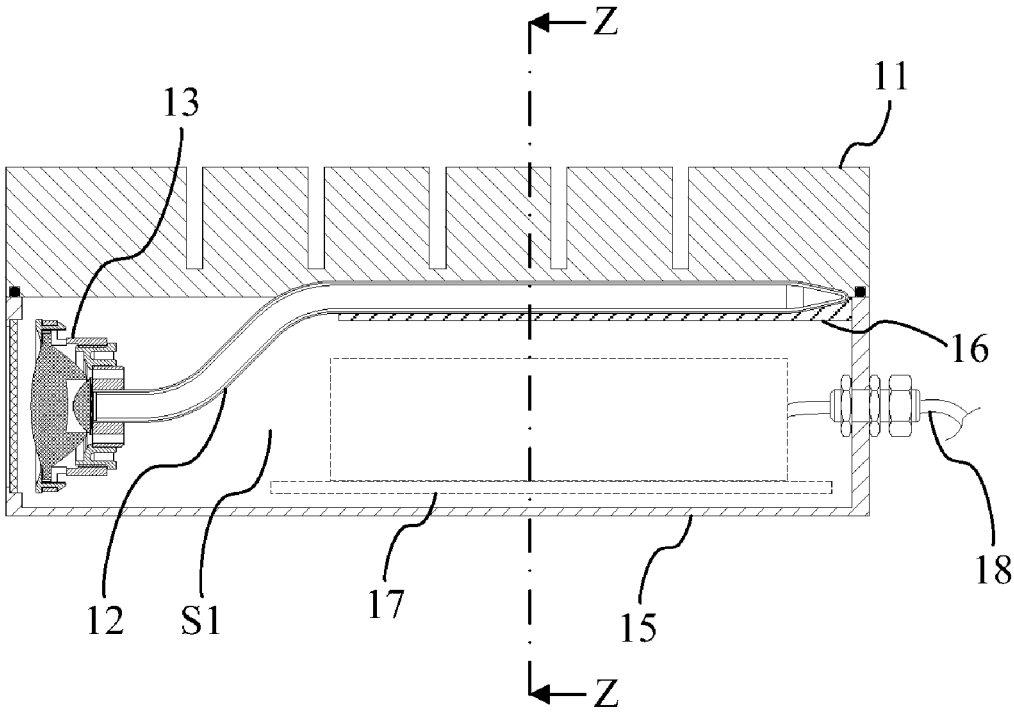
FIG. 2A is a sketch diagram illustrating another spatial configuration of the second heat-conducting devices of the light-emitting diode illuminating equipment.
Figure 2B:
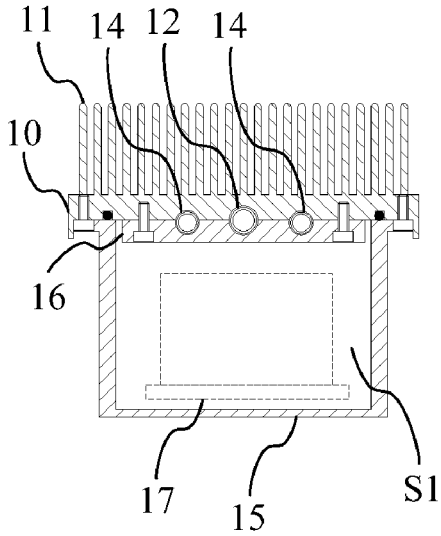
FIG. 2B is a cross section of the light-emitting diode illuminating equipment along Z-Z line in FIG. 2A.

The second heat-conducting devices 14 are disposed on the second surface 104 of the heat-dissipating plate device 10 and are arranged between the heat-dissipating fins, so that heat produced in operation by the diode light-emitting apparatus 13 is distributed uniformly on the heat-dissipating plate device 10 and then is dissipated by the heat-dissipating plate device 10 and the heat-dissipating fins 11. The second heat-conducting devices 14 can be deformed to be tightly mounted on the second surface 104 of the heat-dissipating plate device 10 to increase the distribution efficiency of heat. Please refer to FIGS. 2A and 2B additionally. FIG. 2A is a sketch diagram illustrating another spatial configuration of the second heat-conducting devices 14 of the light-emitting diode illuminating equipment 1. FIG. 2B is a cross section of the light-emitting diode illuminating equipment 1 along Z-Z line in FIG. 2A. It is noticed that the second heat-conducting devices 14 are alternatively disposed on the first surface 102 of the heat-dissipating plate device 10, as shown in FIGS. 2A and 2B. In this case, the second heat-conducting devices 14 are also mounted on the first surface 102 by the depressor 16. There are also several recesses formed on the first surface 102 of the heat-dissipating plate device 10 to fit the second heat-conducting devices 14. Furthermore, the second heat-conducting devices 14 are disposed parallel to the first portion 122 of the first heat-conducting device 12, but the invention is not limited to this. For example, they are disposed perpendicular to the first portion 122.

Figure 3A:
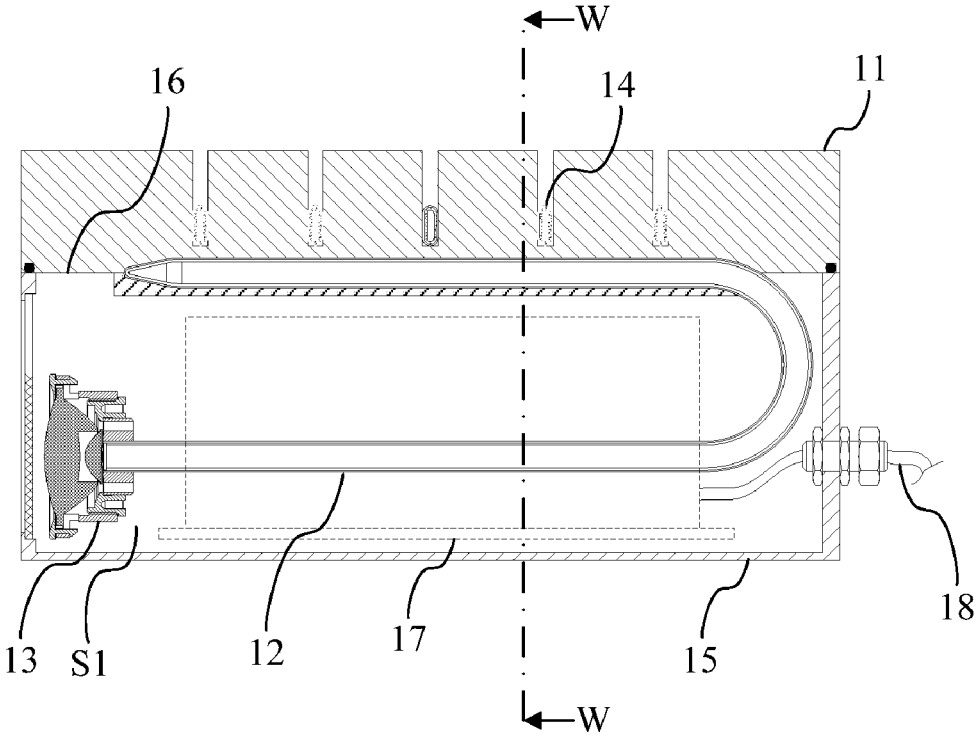
FIG. 3A is a sketch diagram illustrating another spatial configuration of the first heat-conducting device of the light-emitting diode illuminating equipment.
Figure 3B:
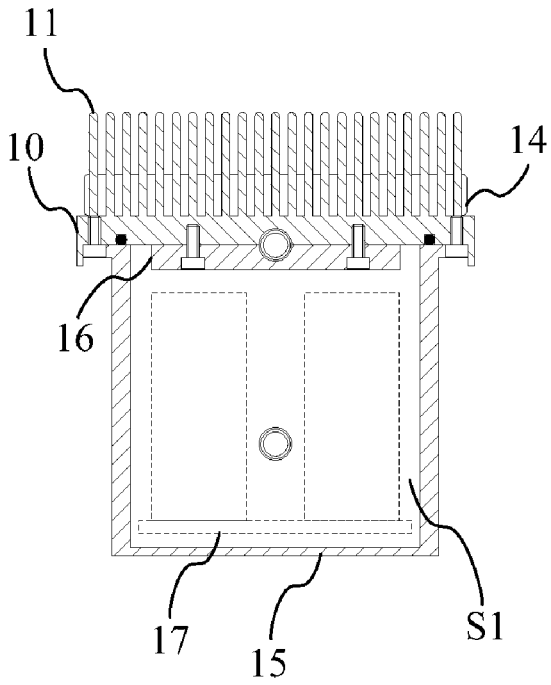
FIG. 3B is a cross section of the light-emitting diode illuminating equipment along W-W line in FIG. 3A.

Please refer to FIG. 1A to 1C. The shield device 15 is engaged with a circumference of the heat-dissipating plate device 10 via a heat-isolating ring 152 to form a sealed space S1 accommodating the diode light-emitting apparatus 13 and the first heat-conducting device 12. Please refer to FIGS. 3A and 3B additionally. FIG. 3A is a sketch diagram illustrating another spatial configuration of the first heat-conducting device 12 of the light-emitting diode illuminating equipment 1. FIG. 3B is a cross section of the light-emitting diode illuminating equipment 1 along W-W line in FIG. 3A. The actual configuration of the first heat-conducting device 12 in the sealed space S1 depends on practical product design, especially on possible interference with the control circuit 17. Therefore, there is a possible configuration as shown in FIGS. 3A and 3B.

Please refer to FIG. 1A to 1C. The shield device 15 is also mounted by other screws 154. The shield device 15 has a transparent shield 156 which enables the light emitted by the diode light-emitting apparatus 13 to pass through for illumination. It is noticed that the heat-isolating ring 152 is not limited to the O-ring as shown in the figures, and other sealing washers are also applicable. Furthermore, the connection between the shield device 15 and the heat-dissipating plate device 10 can be made by other sealing method to form the sealed space S1, such as spreading the engaged portion or the engaged surface with waterproof or dustproof jelly. In addition, the connection between the shield device 15 and the heat-dissipating plate device 10 can also be made by clasps, clips or other fixtures, even by directly soldering to form the sealed space S1 directly.

The control circuit 17 is disposed in the sealed space S1 and electrically connected to the diode light-emitting apparatus 13 for controlling the diode light-emitting apparatus 13 to emit the light. A power cord 18 passes through a waterproof passage 158 of the shield device 15 to power the control circuit 17. The waterproof passage 158 can perform waterproofing by a waterproof joint as shown in FIG. 1B, or by directly filling the gap between the waterproof passage 158 and the power cord 18 with waterproof or dustproof material to seal and mount.

In an embodiment, the waterproof passage 158 can be replaced by a waterproof connector. The waterproof connector connects the control circuit 17 in the sealed space S1 and also connects a power source outside for directly supplying power or charging.

Figure 4A:
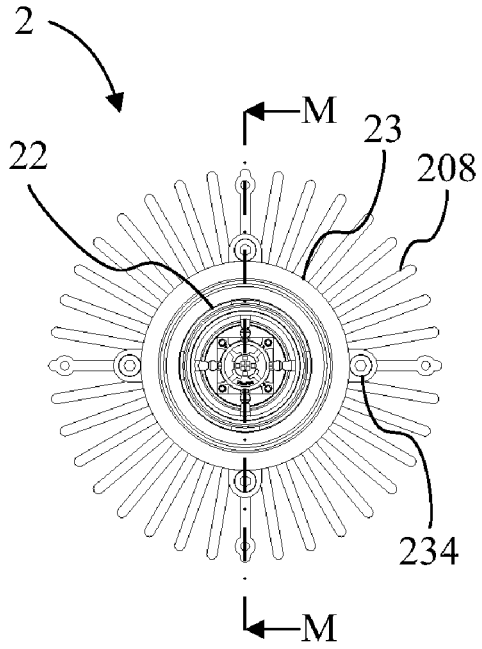
FIG. 4A is a sketch diagram illustrating a light-emitting diode illuminating equipment according to a second preferred embodiment of the invention.
Figure 4B:
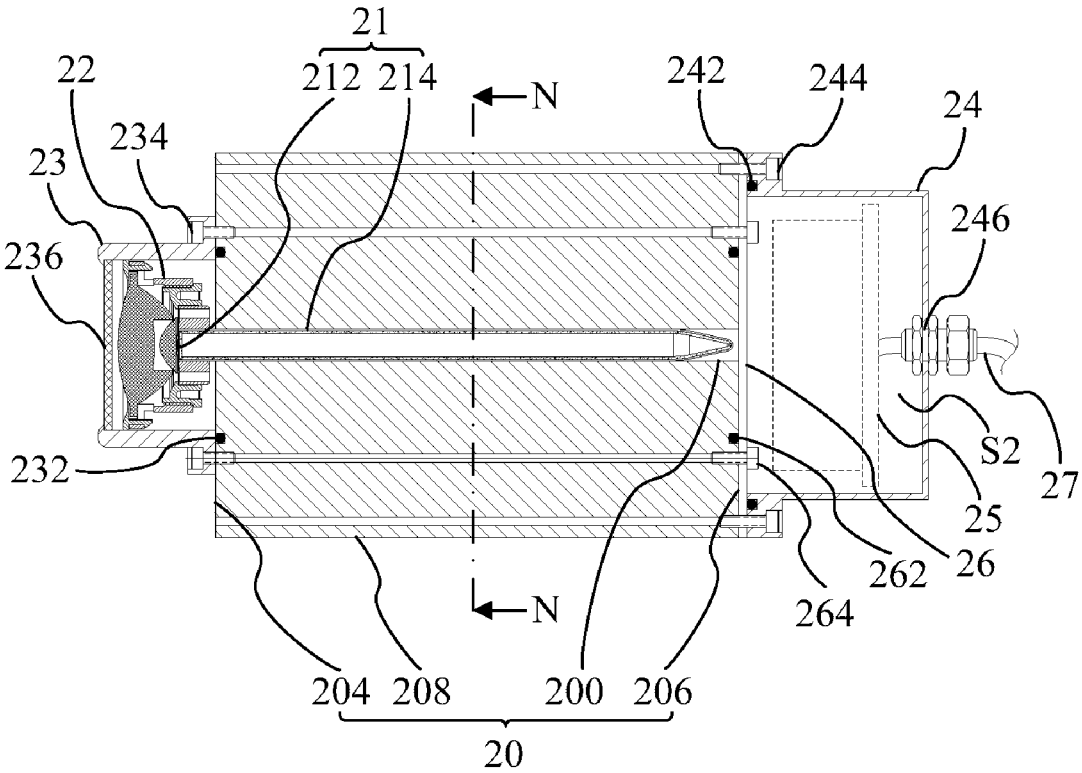
FIG. 4B is a cross section of the light-emitting diode illuminating equipment along M-M line in FIG. 4A.
Figure 4C:
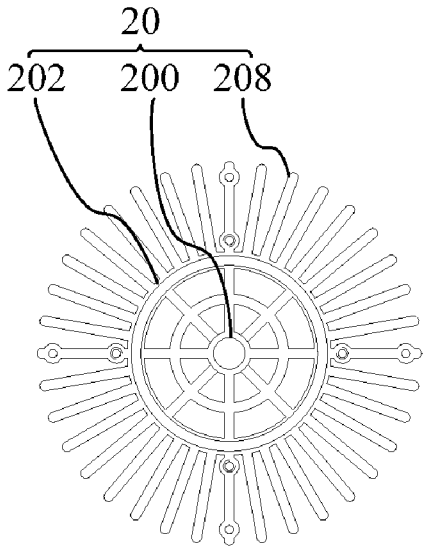
FIG. 4C is a cross section of the light-emitting diode illuminating equipment along N-N line in FIG. 4B.

Please refer to FIG. 4A through 4C. FIG. 4A is a sketch diagram illustrating a light-emitting diode illuminating equipment 2 according to a second preferred embodiment of the invention. FIG. 4B is a cross section of the light-emitting diode illuminating equipment 2 along M-M line in FIG. 4A. FIG. 4C is a cross section of the light-emitting diode illuminating equipment 2 along N-N line in FIG. 4B.

According to the second preferred embodiment, the light-emitting diode illuminating equipment 2 of the invention includes a heat-dissipating device 20, a plurality of heat-dissipating fins 208, a heat-conducting device 21, a diode light-emitting apparatus 22, a first shield device 23, a second shield device 24, and a control circuit 25 (including a circuit board and other electronic components requested).

The heat-dissipating device 20 has a center hole 200, a circumference 202, a front 204, and a rear 206. The heat-dissipating fins 208 are formed to surround the circumference 202 of the heat-dissipating device 20. The heat-conducting device 21 has a flat end 212 and a tail 214. The heat-conducting device 21 is inserted through the tail 214 thereof into the center hole 200 of the heat-dissipating device 20 from the front 204 of the heat-dissipating device 20, such that most of the heat-conducting device 21 is tightly mounted on the inner wall of the center hole 200 and the flat end 212 of the heat-conducting device 21 is disposed outside the heat-conducting device 20. The tight mount can be realized by transition fit or tight fit. It can be alternatively realized by spreading silver in the center hole 200 or on the tail 214 of the heat-conducting device 21 first such that the gap between the tail 214 and the center hole 200 is filled with the silver after the tail 214 is inserted into the center hole 200. The heat-conducting device 21 can be a heat pipe, a vapor chamber, or other device with high heat-conducting efficiency.

The diode light-emitting apparatus 22 is disposed on the flat end 212 of the heat-conducting device 21 and converts electric energy into light. The diode light-emitting apparatus 22 has at least one high power light-emitting diode chip or at least one high power laser diode chip.

The first shield device 23 is engaged with the front 204 of the heat-dissipating device 20 via a first heat-isolating ring 232 to accommodating the diode light-emitting apparatus 22. The first shield device 23 is also mounted by several screws 234. The first shield device 23 has a transparent shield 236 which enables the light emitted by the diode light-emitting apparatus 22 to pass through for illumination. It is noticed that the first heat-isolating ring 232 is not limited to the O-ring as shown in the figures, and other sealing washers are also applicable. Furthermore, the connection between the first shield device 23 and the heat-dissipating device 20 can be made by other sealing method for seal, such as spreading the engaged portion or the engaged surface with waterproof or dustproof jelly. In addition, the connection between the first shield device 23 and the heat-dissipating device 20 can also be made by clasps, clips or other fixtures, even by directly soldering for seal.

The second shield device 24 is engaged with the rear 206 of the heat-dissipating device 20 via a second heat-isolating ring 242 to form a sealed space S2 accommodating the control circuit 25. The second shield device 24 is also mounted by several screws 244. It is noticed that if the sealed space S2 is needed to be larger, because of the geometric structure of the heat-dissipating device 20, a plate 26 is mounted by several screws 264 to seal the rear 206 of the heat-dissipating device 20 together with a third heat-isolating ring 262. Please refer to FIG. 4C (not including the heat-conducting device 21), which shows that there are a plurality of through holes passing through the heat-dissipating device 20 and formed by a plurality of ribs at the axially middle portion of the heat-dissipating device 20. Therefore, the sealing of the plate 26 to the rear 206 of the heat-dissipating device 20 provides a requested seal plane for the second shield device 24 and more importantly, also realizes the completely sealing for the first shield device 23. On another hand, if there is a transverse rib on the heat-dissipating device 20, the aforementioned through holes are modified to be dead holes, and the first shield device 23 can perform the sealing without the plate 26. In an embodiment, if the cross section of the sealed space S2 is substantially equal to the cross section of the sealing of the first shield device 23, the second shield device 24 can seal the aforementioned through holes to form the requested sealed space S2 without the plate 26.

The control circuit 25 is disposed in the sealed space S2 and electrically connected to the diode light-emitting apparatus 22 for controlling the diode light-emitting apparatus 22 to emit the light. The control circuit 25 can be electrically connected to the diode light-emitting apparatus 22 through the aforementioned through holes. A power cord 27 passes through a waterproof passage 246 to supply power. The waterproof passage 246 can perform waterproofing by a waterproof joint as shown in FIG. 4B, or by directly filling the gap between the waterproof passage 246 and the power cord 27 with waterproof or dustproof material to seal and mount.

In another embodiment, the waterproof passage 246 can be replaced by a waterproof connector. The waterproof connector connects the control circuit 25 in the sealed space S2 and also connects a power source outside for directly supplying power or charging.

Therefore, according to the embodiments, the high power light-emitting diode illuminating equipment of the invention has high heat-dissipating efficiency and has a sealed structure adapted for outdoor illumination as well.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. An light-emitting diode illuminating equipment, comprising:

a heat-dissipating plate device and a plurality of heat-dissipating fins extending from the heat-dissipating plate;

a first heat-conducting device mounted to the heat-dissipating plate device and having a flat area;

a diode light-emitting apparatus disposed on the flat area of the first heat-conducting device;

a shield device engaged with a circumference of the heat-dissipating plate device via an isolating ring to form a sealed space accommodating the diode light-emitting apparatus and the first heat-conducting device; and a control circuit electrically connected to the diode light-emitting apparatus for controlling the diode light-emitting apparatus to emit the light;

wherein the shield device has a transparent shield enabling the light emitted by the diode light-emitting apparatus to pass through, and the shield device has a waterproof passage for a power cord passing through.

2. The light-emitting diode illuminating equipment of claim 1, wherein the first heat-conducting device comprises a heat pipe.

3. The light-emitting diode illuminating equipment of claim 1, wherein the diode light-emitting apparatus comprises at least one light-emitting diode chip.

4. The light-emitting diode illuminating equipment of claim 1, wherein the control circuit is disposed in the sealed space.

5. The light-emitting diode illuminating equipment of claim 4, wherein the power cord electrically connecting the control circuit through the waterproof passage.

6. An light-emitting diode illuminating equipment, comprising:

a heat-dissipating device having a concave and a plurality of heat-dissipating fins extending therefrom;

a heat-conducting device mounted on the concave and having a flat end portion;

a diode light-emitting apparatus disposed on the flat portion of the heat-conducting device;

a shield device engaged with a circumference of the heat-dissipating device via an isolating ring to form a accommodating space to accommodate the diode light-emitting apparatus and the heat-conducting device; and a control circuit electrically connected to the diode light-emitting apparatus for controlling the diode light-emitting apparatus to emit the light;

wherein the shield device comprises a transparent shield enabling the light emitted by the diode light-emitting apparatus to pass through, and the accommodating space comprises a waterproof passage for a power cord passing through.

7. The light-emitting diode illuminating equipment of claim 6, wherein the heat-conducting device comprises a heat pipe.

8. The light-emitting diode illuminating equipment of claim 6, wherein the control circuit is disposed in the accommodating space and electrically connecting to the power cord through the waterproof passage.

* * * * *